US006031320A

United States Patent [19]

Kamarehi et al.

[11] Patent Number: 6,031,320

[45] Date of Patent: Feb. 29, 2000

[54] DEVICE FOR COOLING ELECTRODELESS LAMP WITH SUPERSONIC OUTLET JETS AND A STAGGERED MANIFOLD

[76] Inventors: Mohammad Kamarehi, 15526 Owens Ter., N. Potomac, Md. 20878; Aseem Kumar Srivastava, 18501 Boysenberry Dr. #134, Gaithersburg, Md. 20879; Robert D. Wooten, 1704 Lorre Dr., Rockville, Md. 20852

[21] Appl. No.: 09/014,289

[22] Filed: Jan. 27, 1998

[51] Int. Cl.[7] ..... H01J 61/20; H01J 61/12

[52] U.S. Cl. ..... 313/44; 315/112

[58] Field of Search ..... 313/11, 13, 34, 313/39, 44, 12, 35; 315/112, 248; 362/373

[56] References Cited

U.S. PATENT DOCUMENTS 4,695,757 9/1987 Ury et al. ..... 313/44
4,894,592 1/1990 Ervin et al. ..... 315/248
5,021,704 6/1991 Walker et al. ..... 313/35
5,334,913 8/1994 Ury et al. ..... 315/248
5,804,922 9/1998 Dolan et al. ..... 315/32
5,866,980 2/1999 Dolan et al. ..... 313/570

*Primary Examiner*—Vip Patel
*Assistant Examiner*—Matthew J. Gerike
*Attorney, Agent, or Firm*—Pollock, Vande Sande & Amernick, R.L.L.P.

[57] ABSTRACT

An apparatus for cooling an electrodeless lamp including a supersonic outlet jet for providing a stream of cooling gas. A common manifold including mounting elements for a plurality of conduits of equal length for transporting cooling gas, wherein the mounting elements are at staggered elevational positions so that the conduits provide cooling gas in the vicinity of lamp envelope at different elevational positions.

8 Claims, 5 Drawing Sheets

DEVICE FOR COOLING ELECTRODELESS LAMP WITH SUPERSONIC OUTLET JETS AND A STAGGERED MANIFOLD

The present invention relates to a method and apparatus for cooling electrodeless lamps.

BACKGROUND OF THE INVENTION

Electrodeless lamps with which the present invention is concerned generally comprise a lamp envelope containing a plasma-forming medium. The medium in the envelope is excited with microwave, RF or other electromagnetic energy, thereby generating a plasma which emits radiation in the ultraviolet, visible or infrared part of the spectrum. Important uses of such electrodeless lamps are in connection with semiconductor manufacturing operations and for curing coatings or inks by photopolymerization reactions.

An electrodeless lamp transfers large amounts of heat to the lamp envelope during operation, and it has been found that the effectiveness with which the lamp envelope is cooled limits the overall lamp performance. Specifically, the brightness with which energy is radiated by the lamp increases as the power density of the microwave or other energy in the lamp envelope increases. However, as the power density increases, the envelope temperature increases, eventually reaching a temperature at which the envelope melts if not adequately cooled. Thus, the brightness which can be obtained from a lamp is dependent upon the ability to cool the lamp envelope. Moreover, even where a lamp operates satisfactory at a given envelope temperature, further cooling of the envelope to a lower temperature substantially increases the life of the bulb.

Several apparatuses for cooling electrodeless lamps are known, examples of which are is disclosed in U.S. Pat. Nos. 5,021,704, 4,485,332, and 4,042,850. These known methods include techniques certain extent, and for achieving a uniform temperature profile on the surface of the envelope. However, operation at still higher powers require a better approach to cooling.

Prior art cooling devices use common convergent outlet nozzles on cooling conduits which provide cooling air flow to the lamp envelope. In convergent cooling conduit nozzles, the nozzle exit is the smallest section through which gas flows. In this type of nozzle, gas flows from a large diameter entry portion, through a tapered section of the conduit nozzle where the flow area of the nozzle is steadily diminished until the gas reaches the nozzle exit. With convergent nozzles, the maximum velocity that can be obtained is the sonic velocity at the nozzle exit. This maximum velocity is obtained as the pressure at the nozzle exit approaches that of a critical pressure of the particular gas. If the pressure at the nozzle exit is greater than the critical pressure of the gas, the exit velocity is less than sonic velocity. Raising the exit pressure beyond the critical pressure of the gas will not increase the exit velocity. Also, if the exit pressure is substantially below that of the critical pressure of the gas, a sudden uncontrolled expansion will occur at the nozzle exit causing a disruption in the smooth jet flow, and consequently, lesser air flow velocity to the lamp envelope.

Existing electrodeless lamps use a plurality of cooling conduits extending from and secured to a cavity wall of the electrodeless lamp. Cooling air flows through these conduits and outlet nozzles in the conduits to the surface of the lamp envelope as the envelope rotates. The cooling conduits typically are deployed in a circumferential pattern around the lamp envelope. For better and more uniform cooling, it is desirable to position the conduit nozzles surrounding the lamp envelope in different horizontal planes to provide air to the lamp envelope at several elevations with respect to the envelope.

In order to provide varying elevational locations for the cooling conduit outlet nozzles, existing cooling conduits for such lamps have been designed with varying lengths, typically three standard sizes. These variable size conduits are necessary to achieve the differing elevational locations of the nozzles because the design of existing cooling systems are limited to securing the cooling conduits to the cavity wall in a common horizontal plane with respect to each other.

This existing design of cooling conduits has several disadvantages. Lamp envelopes of these lamps are attached via their own conduit extending upward to a manifold. The lamp envelope is vertically adjustable for optimizing coupling of the microwave field. However, since the cooling conduits are fixed to the cavity walls of the lamp, when the vertical position of the envelope is changed, the cooling dynamics of the envelope change due to a change in the relative position of the cooling conduit outlet nozzles with respect to the lamp envelope.

Further, cooling conduits for prior art electrodeless lamps have to be available in several different lengths to accommodate the need to have air exiting different conduit nozzles at different elevations relative to the lamp envelope. Having varying length cooling conduits increases costs associated with producing electrodeless lamps as well as costs associated with providing spare parts for the lamps. Even more troublesome is the problem, when replacing cooling conduits, of assuring that a proper length conduit is installed in a given position. Installation of a wrong combination of conduit lengths causes overheating and melting of the lamp envelope, resulting in lamp failure.

SUMMARY OF THE INVENTION

In accordance with a first aspect of the invention, an apparatus is provided comprising means for providing a source of cooling gas; conduit means for carrying the cooling gas from the source of cooling gas and in a vicinity of the lamp envelope; and a supersonic outlet jet for providing a stream of cooling gas from the conduit means toward the lamp envelope for cooling the lamp envelope.

The supersonic outlet jet of the present invention advantageously increases air velocity from the nozzle thereby increasing the amount of cooling for a given lamp envelope. This extra cooling allows for higher power lamps and extends the life of lamp envelopes. The supersonic outlet jet also increases the efficiency of convective cooling of lamp envelopes, allowing for less consumption of air for a given amount of cooling. Moreover, using supersonic outlet jets allows for fewer cooling conduits per electrodeless lamp for a given amount of cooling.

In accordance with a second aspect of the invention, an apparatus for cooling an electrodeless lamp having a lamp envelope which is capable of becoming extremely hot during operation is provided comprising means for providing a source of cooling gas; a plurality of conduit means having substantially equal lengths for carrying the cooling gas from the source of cooling gas and in a vicinity of the lamp envelope; and a common manifold for securing the lamp envelope and the conduit means.

In accordance with a further aspect, there is a mounting element for each of the conduit means wherein the mounting elements are staggered vertically to provide cooling gas in the vicinity of the lamp envelope in differing vertical positions with respect to the lamp envelope. The mounting elements may be adjustable whereby the conduit means are vertically adjustable for optimization.

Having only one size of cooling conduits advantageously reduces the risk of errors when installing replacement conduits as well as reduces costs associated with providing replacement conduits. To allow for outlet nozzles to be positioned in varying elevational positions with respect to the lamp envelope, the cooling conduit mounting elements are advantageously staggered in differing horizontal planes.. Also, having a common manifold for securing both the cooling conduits and the lamp envelope allows for simultaneous adjustment of the cooling conduits when the lamp envelope is adjusted.

DETAILED DESCRIPTION OF PREFERRED EMBODIMENTS

Figure 1:
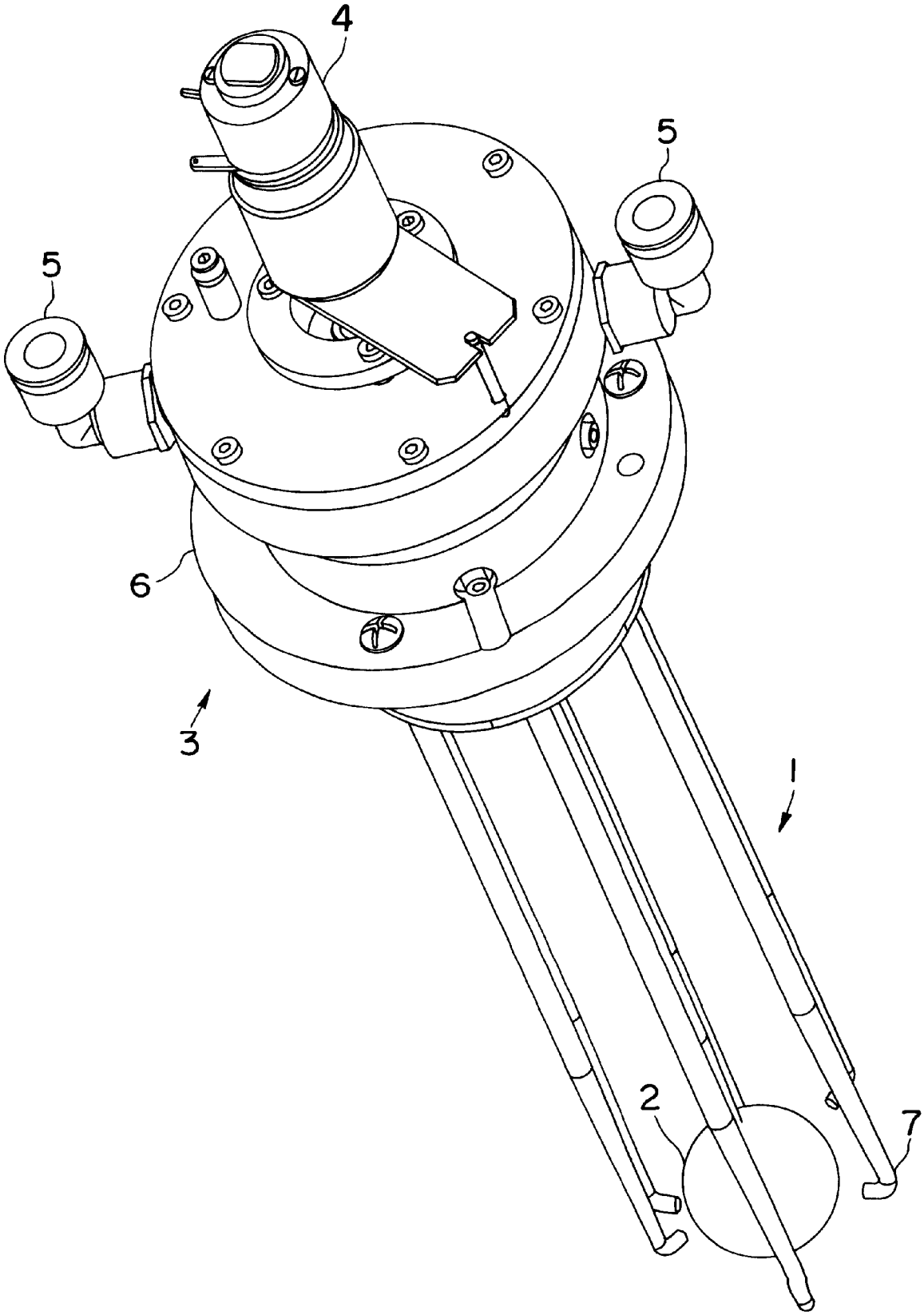
FIG. 1 is a top perspective view of an electrodeless lamp and a device for cooling an electrode less lamp according to the present invention.
Figure 2:
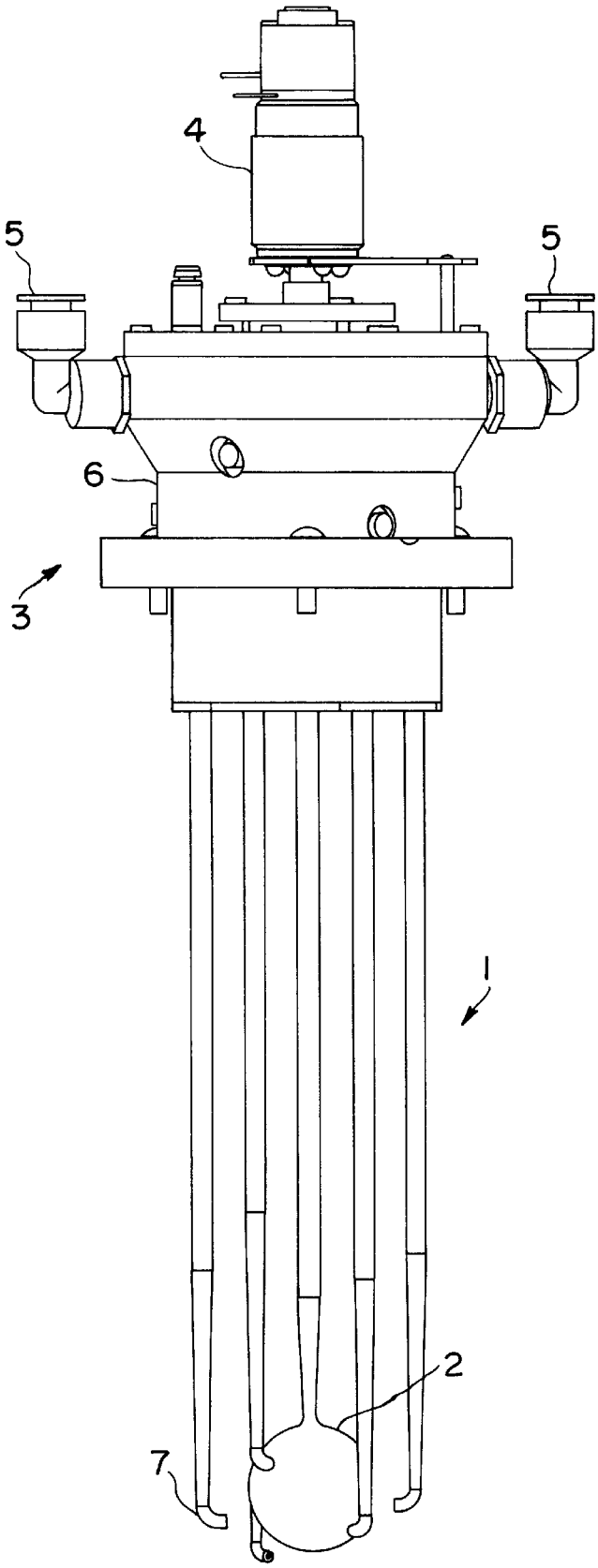
FIG. 2 is a side view of an electrodeless lamp and a device for cooling an electrode less lamp according to the present invention.

FIGS. 1 and 2 show perspective and side views of a preferred embodiment of the invention. The embodiment includes six cooling conduits 1 and lamp envelope 2, all extending from an assembly structure 3. The assembly structure includes motor assembly 4, air inlet ports 5, and assembly casing 6.

It is well known in the art that the cooling conduits should be designed to provide even cooling on the surface of the lamp envelope. Thus, typical cooling conduit designs include mounting cooling conduits to extend generally circumferentially around the lamp envelope similar to that as shown in FIG. 1. It is also known to provide outlet nozzles which direct cooling air onto the lamp envelope at differing elevational positions relative to other nozzles. Preferred elevational arrangements of nozzles to provide the most efficient cooling for a given lamp are also known in the art. Rather than providing cooling conduits of differing lengths to attain preferred arrangements of nozzles, the present invention teaches the use of equal length cooling conduits having conduit mounts of differing elevational positions within the assembly casing to provide specific elevational nozzle arrangements around the lamp envelope.

As will be more clearly described below, air entering air inlet ports 5 from an air source (not shown) enters cooling conduits 1 inside assembly structure 3 and exits through an outlet nozzle 7 in each cooling conduit in the vicinity of lamp envelope 2 to provide cooling air to the lamp envelope 2.

Figure 3:
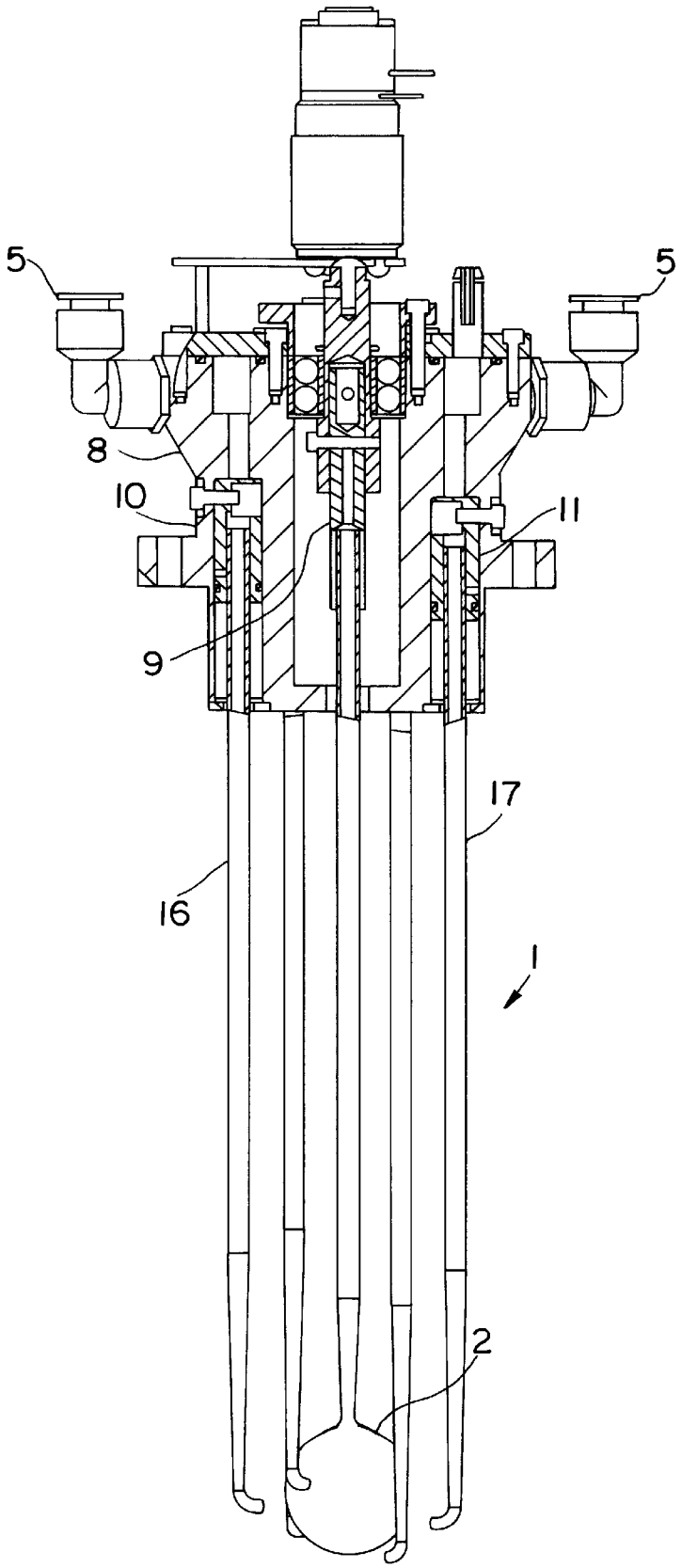
FIG. 3 is a sectional view of an electrodeless lamp and a device for cooling an electrode less lamp according to the present invention.

FIG. 3 shows a sectional view of a preferred embodiment of the invention. Six cooling conduits 1 and lamp envelope 2 are mounted in a common manifold 8. The lamp envelope is secured at lamp mount 9 and each of cooling conduits 1 are secured at respective distinct conduit mounts (only two conduit mounts, 10 and 11, are shown) on common manifold 8. Cooling conduits 1 have equal lengths and preferably have equal flow capacities. Air flows from inlet ports 5 to the common manifold 8 and into each of the six cooling conduits 1.

Each of the conduit mounts has a distinct predetermined elevational positions, i.e., fixed offsets, within the assembly structure 3. As can be seen from FIG. 3, conduit mount 10 is mounted within the assembly structure 3 at a higher vertical position than conduit mount 11. Thus, cooling conduit 16, mounted in conduit mount 10, is mounted at a higher elevation within the assembly structure 3 than cooling conduit 17, mounted in conduit mount 11. Since cooling conduits 16 and 17 are of equal length, the difference in the relative elevational positions at which the respective outlet nozzles of cooling conduits 16 and 17 convey air to the surface of the lamp envelope 2 is equal to a vertical component of the distance between conduit mounts 10 and 11.

Since cooling conduits 1 and the lamp envelope 2 are mounted on a common manifold 8, when the height of lamp envelope 2 is adjusted by adjusting the position of common manifold 8, cooling conduits 1 automatically adjust with the lamp envelope.

Figure 5:
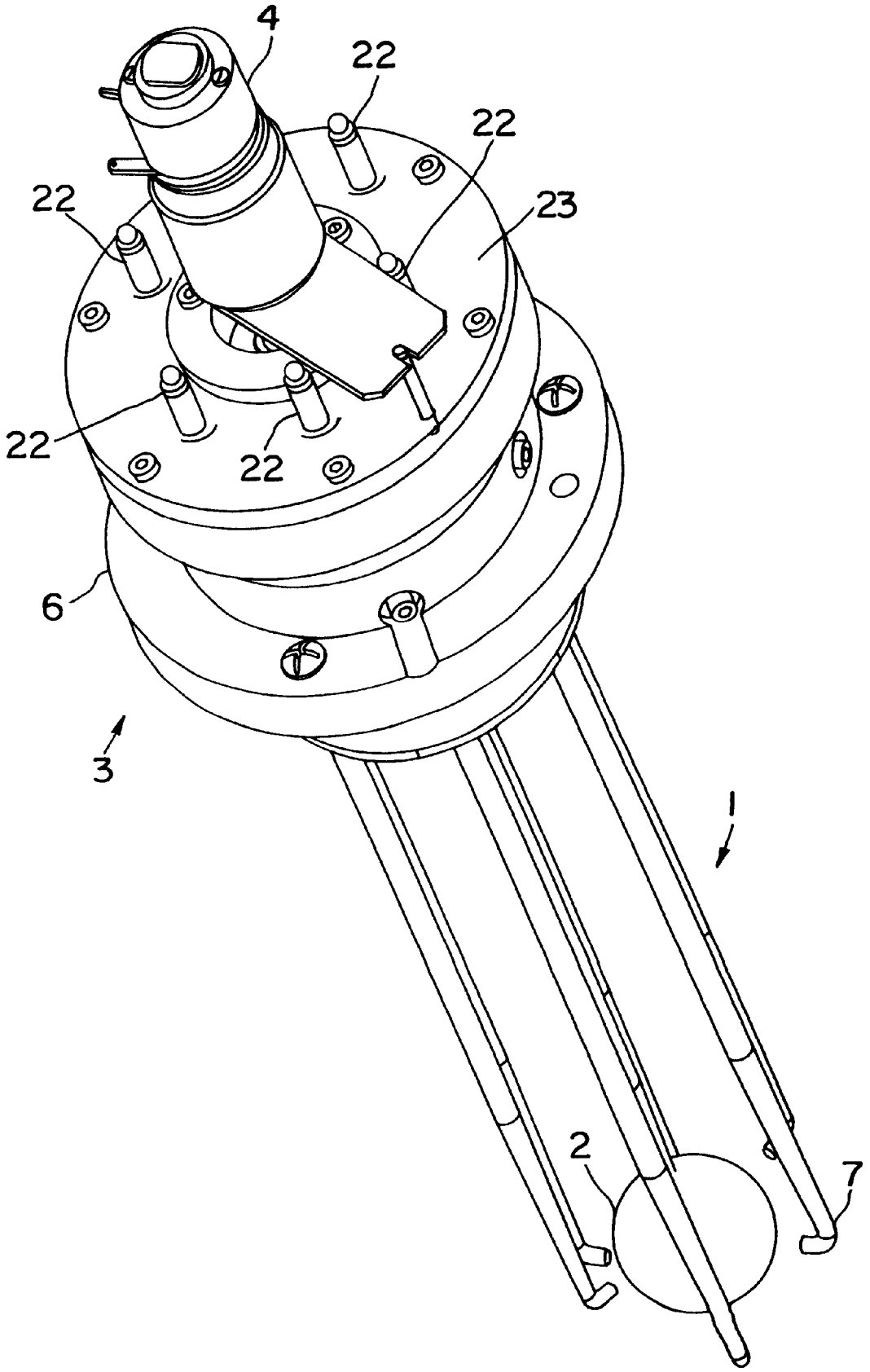
FIG. 5 is a top perspective view of an electrodeless lamp and a device for cooling an electrode less lamp having adjustable cooling conduits.

In another embodiment of the invention shown in FIG. 5, cooling conduits 1 are adjustably mounted within assembly casing 6. Top ends 22 of these cooling conduits 1 extend through upper surface 23 of assembly casing 6 so that each cooling conduit can be adjusted upward without any limiting barrier. The top end of each cooling conduit is connected to its own individual air source.

A cooling device with adjustable cooling conduits as described above allows a technician or engineer to experiment with varying combinations of vertical positions of cooling conduits 1. When preferred elevational arrangements of cooling conduits are discovered using this device, commercial units can be constructed such as those of FIGS. 1–3, fixing the positions of the conduit mounts in common manifold 8 to those of the new arrangement.

Turning to another aspect of the invention, the higher the velocity of air flowing across the surface of a lamp envelope, the more cooling can be attained and, thus, higher powered lamps can be employed. Likewise, where a given cooling conduit can provide more cooling via a higher velocity air flow, less conduits are required to provide a given amount of cooling. The present invention includes a convergent-divergent nozzle arrangement to create higher velocity gas flow than that available in prior art devices.

Figure 4:
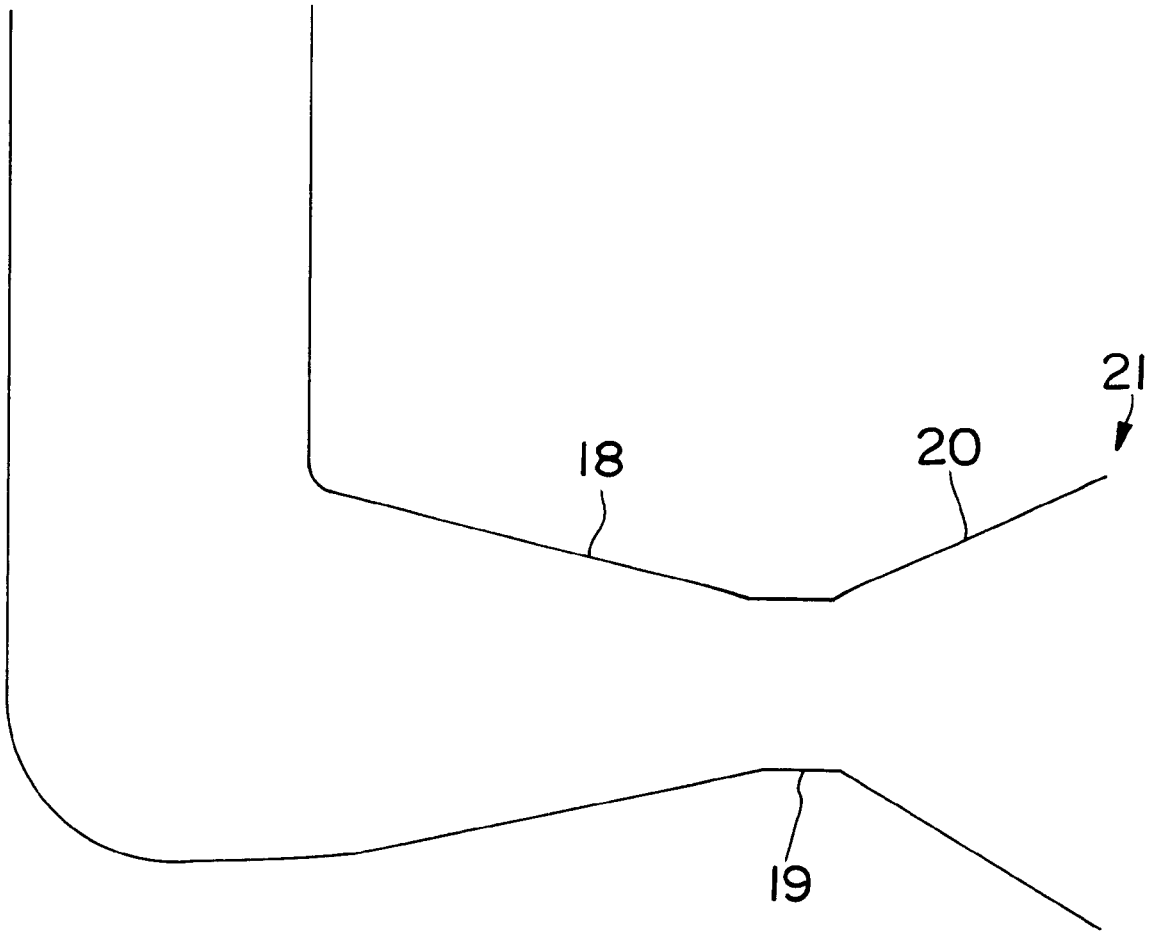
FIG. 4 is a view of a supersonic jet outlet nozzle according to the present invention.

FIG. 4 shows a convergent-divergent supersonic jet nozzle according to the present invention. The convergent-divergent nozzle comprises a converging section 18, throat 19, diverging section 20 and exit 21. The throat is a point of minimum cross sectional area of the nozzle. Similar to a prior art convergent nozzle, sonic velocity can be attained at the end of the convergent section, i.e., at the throat, as the pressure at the throat approaches that of a critical pressure of the particular gas flowing through the nozzle. However, as the gas passes from throat 19 into diverging section 20, the velocity of the gas increases to supersonic velocities and flows through exit 21 toward lamp envelope 2. The super sonic gas flow rate toward lamp envelope 2 causes greater convective heat transfer at the surface of lamp envelope 2 and better cooling of the lamp.

The convergent-divergent nozzle is preferably made of quartz. Other materials which do not absorb microwave energy are also acceptable such as ceramic materials. These convergent-divergent nozzles typically have very small dimensions to cooperate with cooling conduits of the size commonly required for cooling lamp envelopes. Preferably, throat 19 of the nozzle is about 0.035 inches in diameter, the length of convergent section 20 is about 0.1 inches and the cross sectional diameter of exit 21 is 0.040 inches to achieve the best supersonic velocities at the exit of a nozzle of a typical cooling conduit. With these dimensions, the inlet pressure to the nozzle should be at least three atmospheres and the pressure at the exit of the nozzle and around the lamp envelope should be at atmospheric pressure to achieve best nozzle performance.

It should be appreciated that the above embodiments are offered for purposes of illustration only and are not limiting. Accordingly, it is intended to protect all subject matter defined by the accompanying claims and equivalents thereof.

We claim:

1. An apparatus for cooling an electrodeless lamp having a lamp envelope which is capable of becoming extremely hot during operation, said apparatus comprising:

means for providing a source of cooling gas;

conduit means for carrying said cooling gas from said source of cooling gas and in a vicinity of said lamp envelope; and a supersonic outlet jet for providing a stream of cooling gas from said conduit means toward said lamp envelope for cooling said lamp envelope.

2. The apparatus according to claim 1 further comprising:

a common manifold for securing said lamp envelope and said conduit means;

wherein said conduit means comprises a plurality of conduits having substantially equal lengths.

3. The apparatus according to claim 2 wherein said common manifold includes a mounting element for each of said conduits, the mounting elements being staggered in said manifold in varying elevational positions to provide cooling gas in the vicinity of said lamp envelope from varying elevational positions around said lamp envelope.

4. The apparatus according to claim 1 wherein said supersonic jet comprises a throat having a diameter of about 0.035 inches, a convergent section having a length of about 0.1 inches and an exit having a diameter of about 0.040 inches.

5. An apparatus for cooling an electrodeless lamp having a lamp envelope which is capable of becoming extremely hot during operation, said apparatus comprising:

means for providing a source of cooling gas;

a plurality of conduit means having substantially equal lengths for carrying said cooling gas from said source of cooling gas and in a vicinity of said lamp envelope; and a common manifold for securing said lamp envelope and said conduit means, wherein said common manifold includes a mounting element for each of said conduit means, the mounting elements being staggered vertically to provide cooling gas in the vicinity of said lamp envelope in differing elevational positions with respect to said lamp envelope.

6. The apparatus according to claim 5 further comprising a supersonic outlet jet on each of said plurality of conduit means for providing a stream of cooling gas from said conduit means toward said lamp envelope for cooling said lamp envelope.

7. An apparatus for cooling an electrodeless lamp having a lamp envelope which is capable of becoming extremely hot during operation, said apparatus comprising:

means for providing a source of cooling gas;

a plurality of conduit means having substantially equal lengths for carrying said cooling gas from said source of cooling gas and in a vicinity of said lamp envelope; and a common manifold for securing said lamp envelope and said conduit means, wherein said common manifold includes an adjustable mounting element for each of said conduit means, said adjustable mounting elements allowing said conduit means to be vertically adjusted.

8. An apparatus for cooling an electrodeless lamp having a lamp envelope which is capable of becoming extremely hot during operation, said apparatus comprising:

means for providing a source of cooling gas;

a plurality of conduit means having substantially equal lengths for carrying said cooling gas from said source of cooling gas and in a vicinity of said lamp envelope; and a common manifold for securing said lamp envelope and said conduit means, further comprising a supersonic outlet jet on each of said plurality of conduit means for providing a stream of cooling gas from said conduit means toward said lamp envelope for cooling said lamp envelope.

* * * * *